United States Patent [19]

Gray

[11] 4,208,559

[45] Jun. 17, 1980

[54] SWITCH ACTUATING DEVICE AND METHOD OF ASSEMBLING

[75] Inventor: Steven J. Gray, DeKalb, Ill.

[73] Assignee: General Electric Company, Fort Wayne, Ind.

[21] Appl. No.: 972,451

[22] Filed: Dec. 22, 1978

[51] Int. Cl.[2] ..... H01H 9/32

[52] U.S. Cl. ..... 200/329; 29/622; 200/80 R

[58] Field of Search ..... 200/80 R, 329, 330, 200/336; 73/535, 539, 551; 310/68 E; 318/325, 793; 29/622; 74/25, 61

[56] References Cited

U.S. PATENT DOCUMENTS

| | | | |
|---|---|---|---|
| 2,372,064 | 3/1945 | Esarey | 73/539 |
| 2,419,141 | 4/1947 | Johns et al. | 200/80 R |
| 2,473,998 | 6/1949 | Janette | 200/80 R |
| 2,767,274 | 10/1956 | Ritter | 200/80 R |
| 2,788,206 | 4/1957 | Staak | 200/80 R X |
| 2,831,153 | 4/1958 | Deming et al. | 200/80 R X |
| 3,271,602 | 9/1966 | Waters | 318/325 X |
| 3,699,816 | 10/1972 | Peltret | 73/539 X |

*Primary Examiner*—Stephen Marcus
*Attorney, Agent, or Firm*—Joseph E. Papin

[57] ABSTRACT

A switch actuating device adapted for conjoint rotation with a rotatable assembly of a prime mover. Means for mounting to the rotatable assembly so as to be conjointly rotatable therewith includes a pair of sets of opposite surfaces, and switch operating means conjointly rotatable with the mounting means is arranged for axial movement thereon between a pair of opposite positions. A pair of centrifugal weight members are responsive to the rotational speed of the device to effect the axial movement of the switch operating means between its opposite positions and include a pair of sets of means arranged for guiding engagement on the opppposite surface set pair upon the axial movement of the switch operating means between its opposite positions, respectively. A pair of springs are respectively biased between the centrifugal members.

A method of assembling a switch actuating device is also disclosed.

20 Claims, 9 Drawing Figures

SWITCH ACTUATING DEVICE AND METHOD OF ASSEMBLING

FIELD OF THE INVENTION

This invention relates generally to prime movers and in particular to a switch actuating device therefor and a method of assembling a switch actuating device.

BACKGROUND OF THE INVENTION

In the past, various different switching arrangements were utilized in prime movers, such as for instance an electric motor of the split phase type, to control the energization of a winding circuit for the prime mover. In some of these past switching arrangements, a support member was either fixedly attached to a rotatable assembly of the prime mover for conjoint rotation therewith or was attached thereto by suitable means which generally prevented axial movement of the support member while permitting some relative rotational movement within preselected limits. A switch actuator, such as a push collar for instance, was disposed either on a part of the support member or on a part of the rotatable assembly, and the push collar was conjointly rotatable with the support member and also arranged for axial movement relative thereto between an at-rest or standstill position and a displaced or rotatably actuated position. A pair of centrifugal weight members were pivotally interconnected between the support member and the push collar, and a pair of springs were biased between the centrifugal weight members urging them toward their pivotal association with the support member and the push collar. The centrifugal weight members were pivotally operable in response to the rotational speed of the rotatable assembly upon the energization of the winding circuit of the prime mover to drive the push collar axially from its standstill position to its displaced position generally as the rotational assembly attained a preselected or synchronous speed thereof. This axial movement of the push collar was effective to cause the operation of linkage means pivotally mounted on the prime mover and operably associated with the push collar for actuating an electrical switch of the prime mover which controlled the energization of an auxiliary winding means and a main winding means of the prime mover winding circuit. In this manner, the electrical switch was actuated in response to the aforementioned axial movement of the push collar to its displaced position to effect the deenergization of the auxiliary winding means in the winding circuit of the prime mover generally as the rotatable assembly attained its preselected speed, and thereafter the prime mover was energized only in response to the continued energization of the main winding means in the prime mover winding circuit.

At least one of the disadvantageous or undesirable features of these past switching arrangements or centrifugal switch actuating mechanism is believed to be that of a noise problem involved upon the centrifugal operation thereof. In other words, due to the resilient interconnection by the springs of the centrifugal weight members between the support member and the push collars, it is believed that at least some of the past centrifugal switch actuating mechanisms chattered or rattled when they operated in response to the rotational speed of the prime mover rotatable assembly. Of course, this noise problem may have been in part alleviated in other ones of the past centrifugal switch actuating mechanisms wherein the support member and push collar thereof were formed from a resin material with only the centrifugal weight members respectively associated therewith being metallic.

SUMMARY OF THE INVENTION

Among the several objects of the invention may be noted the provision of an improved switch actuating device and an improved method of assembling a switch actuating device which overcome the above discussed disadvantageous or undesirable features, as well as others, of the prior art; the provision of such improved switch actuating device and method having an anti-chatter construction; the provision of such improved switch actuating device and method in which a pair of centrifugal weight members of the switch actuating device are mechanically caged on a support member therefor; the provision of such improved switch actuating device and method in which a push collar of the switch actuating device may be associated with the support member only in a preselected assembly relation or position; and the provision of such improved switch actuating device and method in which the components utilized therein are simplistic in design, easily assembled together, and economically manufactured. These as well as other objects and advantageous features will be in part apparent and in part pointed out hereinafter.

In general, a switch actuating device in one form of the invention is adapted for conjoint rotation with a rotatable assembly of a prime mover. The device includes means adapted for mounting it to the rotatable assembly, and a pair of centrifugal weight members associated with the mounting means so as to be slidable generally in a radial direction thereon when the device is conjointly rotated with the rotatable assembly. Opposed means respectively integral with the centrifugal weight members are slidable on oppositely facing confronting parts of the mounting means for mechanically caging the at least one centrifugal weight member generally against movement with respect to the mounting means in directions other than the radial direction at least during the conjoint rotation of the device with the rotatable assembly of the prime mover.

Also in general and in one form of the invention, a switch actuating device is adapted for conjoint rotation with a rotatable assembly of a prime mover. The device is provided with a hub having a pair of opposite end portions, and an outer peripheral portion is provided on the hub. A bore extending generally axially through the hub between the opposite end portions is adapted to be received on the rotatable assembly, and a pair of sets of lands on the peripheral surface extend generally axially between the opposite end portions with one of the land sets having a configuration different than that of the other of the land sets. A pair of arms are integrally formed with the hub generally adjacent one of the end portions thereof and extend generally radially in opposite directions from the hub, respectively. A generally annular push collar has another bore extending generally axially therethrough, and the another bore is arranged at least in part generally about the peripheral portion on the hub. A pair of sets of grooves in the push collar intersect with the another bore and extend generally axially thereof, and the groove set pair have configurations generally complimentary to those of the land set pair so as to be received in axial sliding and guiding engagement therewith, respectively. A pair of centrifugal weight members are pivotally engaged with the push collar and slidably engaged with the arm pair, respectively, and a pair of means are biased between the centrifugal weight members for urging them toward the respective engagements thereof with the push collar and the arm pair.

Still further and in general, a method is provided in one form of the invention for assembling a switch actuating device having a push collar, a pair of centrifugal weight members, and means for mounting the switch actuating device with the mounting means a generally axially extending hub and also having a pair of generally radially extending opposite arms with each of the arms having a pair of sets of oppositely facing surfaces, respectively. In this method, the push collar is disposed in axial sliding relation on the hub. The centrifugal weight members are associated in pivotal engagement with the push collar, and a pair of sets of opposed means on the centrifugal weight members are arranged in sliding engagement with confronting ones of the surface set pair of the arms for mechanically caging the centrifugal weight members on the arms generally against movement with respect thereto other than in the direction of the sliding engagement of the centrifugal weight members on the arms, respectively. A pair of resilient means are biased between the centrifugal weight members for nursing the pivotal engagement between the centrifugal weight members and the push collar and the sliding engagement of the centrifugal weight members with the arms, respectively.

BRIEF DESCRIPTION OF THE DRAWINGS

Corresponding reference characters indicate corresponding parts throughout the several views of the drawings.

The exemplifications set out herein illustrate the preferred embodiments of the invention in one form thereof, and such exemplifications are not to be construed as limiting the scope of the invention or the disclosure thereof in any manner.

DETAILED DESCRIPTION OF THE PREFERRED EMBODIMENTS

Figure 2:
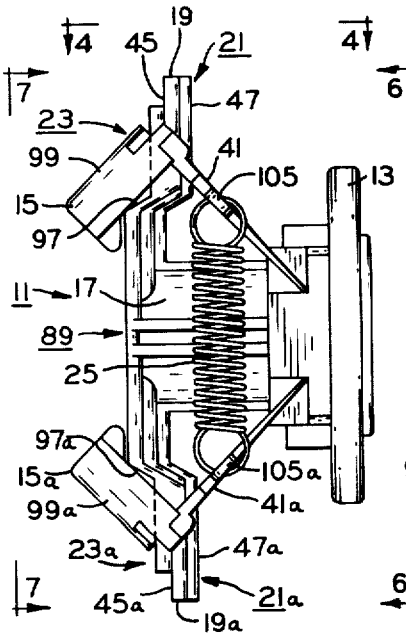
FIG. 2 is an enlarged side elevational view of the switch actuating device of FIG. 1 disassociated from the prime mover.
Figure 3:
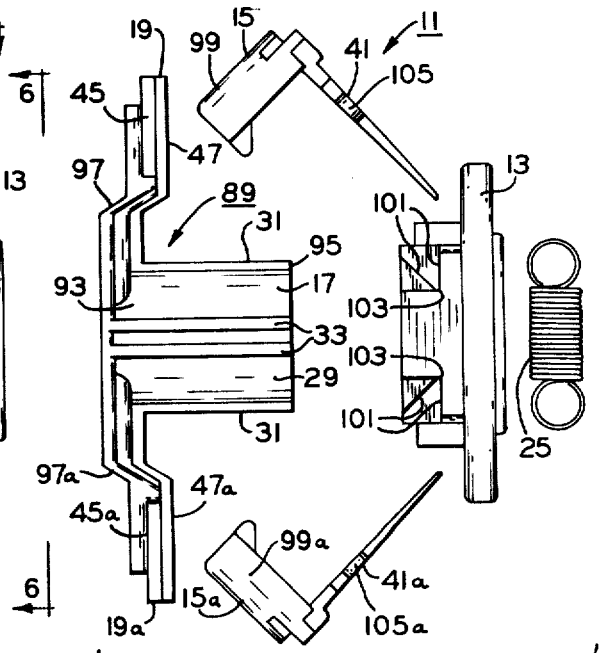
FIG. 3 is an exploded view of the switch actuating device of FIG. 2 illustrating principles which may be practiced in a method of assembling the switch actuating device also in one form of the invention.
Figure 4:
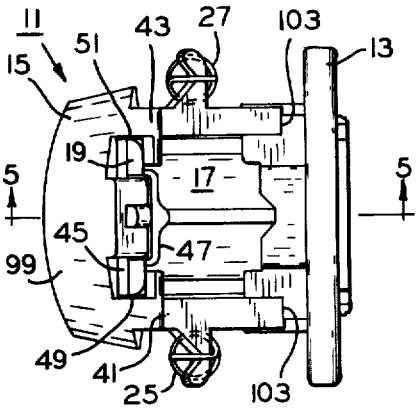
FIG. 4 is a top elevational view of the switch actuating device of FIG. 2.

Referring now to the drawings in general, a method is provided in one form of the invention for assembling a switch actuating device or centrifugal switch mechanism 11 including a generally annular push collar 13, a pair of centrifugal weight members **15,15*a*, and means for mounting the switch actuating device with mounting means having a generally axially extending mounting hub 17 and also having a pair of arms 19,19*a* extending generally radially therefrom with the arms having a pair of sets of oppositely facing surfaces of opposite guides indicated generally at 21,21*a*, respectively (FIGS. 2–8). In this method, push collar 13 is disposed in axial sliding engagement on or generally about mounting hub 17 (FIGS. 2 and 3). Centrifugal weight members 17,17*a* are associated in pivotal engagement with push collar 13, and a pair of sets of means 23,23*a* on the centrifugal weight members are arranged in sliding engagement with opposite guide sets 21,21*a* of arms 19,19*a* for mechanically caging the centrifugal weight members on the arms generally in an anti-chattering relation against movement with respect thereto other than in the direction of the sliding engagement of the centrifugal weight members on the arms, respectively (FIGS. 2–4 and 8). A pair of means, such as springs 25,27 for instance, are biased or otherwise interconnected between centrifugal weight members 17,17*a* for resiliently urging the centrifugal weight members toward the pivotal engagement thereof with push collar 13 and for insuring or otherwise maintaining the sliding engagement of the centrifugal weight members with arms 19,19*a***, respectively, (FIGS. 4, 5, 7 and 8).

Figure 6:
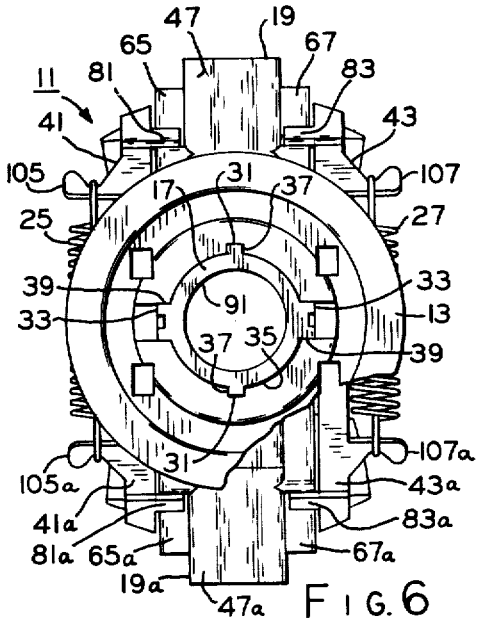
FIG. 6 is a left end view of the switch actuating device of FIG. 2.
Figure 7:
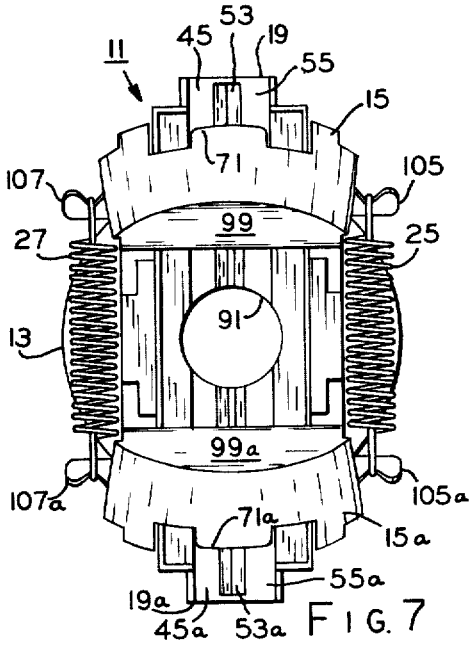
FIG. 7 is a right end view of the switch actuating device of FIG. 2.

More particularly and with specific reference to FIGS. 2, 3 and 6, hub 17 and arms **19,19*a* of centrifugal switch device 11 are integrally formed of a suitable resin material, such as for instance Valox 420 available from the General Electric Company, Pittsfield, Mass. Hub 17 has a peripheral portion or outer peripheral surface 29, and a pair of sets of guide means, such as lands 31,33 or the like for instance, are integrally provided on the peripheral portion extending generally axially of the hub. It may be noted that land set 31 has a configuration different than land set 33, and while land set 31 is illustrated as single opposite lands and land set 33 as double opposite lands, it is contemplated that land sets having other dissimilar configurations and in arrangements other than opposite each other on hub 17** may be utilized within the scope of the invention so as to meet the objects and advantageous features thereof.

Push collar 13 may also be formed of a suitable resin material, such as phenolic material for instance, and a bore or internal surface 35 is axially provided through the push collar. Bore 35 is interrupted by a pair of sets of grooves or groove means 37,39 which extend generally axially through push collar 13, and it may be noted that the groove sets have configurations generally complimentary to those of land sets 31,33, respectively. Thus, when push collar 13 is assembled with hub 17, bore 35 of the push collar is disposed at least in part generally about peripheral portion 29 of the hub, and groove sets 37,39 are received in axial guiding and sliding engagement on land sets 31,33 on the hub, respectively. Further, it may be noted that the engagement of the dissimilar land sets 31,33 or hub 17 with the complimentary groove sets 37,39 on push collar 13 predetermines the assembly position of the push collar with respect to the hub upon the assembly thereof. While land sets 31,33 and groove sets 37,39 are respectively illustrated as being parts of hub 17 and push collar 13 for purposes of disclosure, it is contemplated that the land set may be a part of the push collar and the groove sets a part of the hub within the scope of the invention so as to meet the objects thereof.

With push collar 13 axially slidably assembled about hub 17, as discussed above, caging means sets 23,23a of centrifugal weight members 15,15a may be arranged or otherwise disposed in the sliding engagement with guide sets 21,21a on arms 19,19a so as to be slidable or movable in a direction generally radially with respect to hub 17 thereby to effect the generally anti-chattering relation of the centrifugal weight members with the arms, as seen in FIGS. 2, 4, 7 and 8. Thus, centrifugal weight members 15,15a are mechanically caged generally against movement or displacement with respect to arms 19,19a in directions other than the radial direction in which the centrifugal weight members are adapted to move on the arms in the sliding engagement therewith, respectively. Generally at the same time centrifugal weight members 15,15a are mechanically caged with arms 19,19a, a pair of pivot legs 41,43 and 41a,43a on the centrifugal weight members may be engaged in pivotal association with a plurality of fulcrum or pivot sections 103 therefor provided on push collar 13, respectively. With centrifugal weight members 15,15a associated in pivotal engagement with push collar 13 and arranged in the mechanical caging relation with arms 19,19a, as discussed above, springs or resilient means 25,27 may be biased or otherwise interconnected between pivot legs 41,41a and 43,43a of the centrifugal weight member thereby to urge them toward their at-rest positions, respectively. In this manner, the compressive forces of springs 25,27 are effective to insure or maintain the pivotal engagement of centrifugal weight members 15,15a with push collar 13 and also the sliding engagement of caging means sets 23,23a on the centrifugal weight members with guide sets 21,21a on arms 19,19a, respectively.

In order to effect the aforementioned mechanical caging relation of centrifugal weight members 15,15a with arms 19,19a, it may be noted that the arms respectively comprise a pair of opposite surfaces or faces 45,45a and 47,47a which face generally in the axial direction of hub 17, and a pair of opposite marginal edges or sides 49,51 and 49a,51a are integrally formed or interconnected between the faces, respectively. A pair of stepped slots or grooves 53,55 and 53a,55a are respectively provided in faces 45,45a of arms 19,19a extending generally lengthwise thereof or in the radial direction with respect to hub 17, and each of the stepped slots define a pair of opposed sidewalls in the arms, i.e., slot 53 has opposed sidewalls 57,59, slot 55 has opposed sidewalls 61,64 slot 53a has opposed sidewalls 57a,59a, and slot 55a has opposed sidewalls 61a,63a. On opposite faces 47,47a of arms 19,19a, a pair of slide surfaces or abutments 65,67 and 65a,67a are provided at least generally adjacent marginal edges 49,51 and 49a,51a, respectively. While stepped slot pairs 53,55 and 53a,55a are illustrated herein for purposes of disclosure, it is contemplated that a greater or a lesser number of slots may be provided in arms 19,19a and that such slots may be shaped otherwise than those shown herein within the scope of the invention so as to meet the objects thereof. Centrifugal weight members 15,15a respectively include a pair of stepped extensions 69,71, and 69a,71a, and each of the stepped extensions have a pair of generally opposite side edges, i.e., stepped extensions 67 has opposite side edges 73,75, stepped extension 67 has opposite side edges 77,79, stepped extension 67a has opposite side edges 71a,73a, and stepped extension 69a has opposite side edges 77a,79a. While stepped extension pairs 69,71 and 69a,71a are shown and described herein for purposes of disclosure, it is contemplated that a greater or lesser number of extensions may be provided on centrifugal weight members 15,15a and that such extensions may have configurations other than those illustrated herein within the scope of the invention so as to meet the objects thereof. Also on each of centrifugal weight members 15,15a, a pair of opposed fingers or other surfaces 81,83 and 81a,83a are respectively provided forming abutments arranged in spaced apart relation with respect to stepped extensions 69,71 and 69a,71a. Thus, as weight members 15,15a are arranged in the mechanical caging relation with arms 19,19a, as previously mentioned, stepped extensions 69,71 and 69a,71a on the centrifugal weight members are placed in or otherwise inserted into stepped slots 53,55 and 53a,55a in the arms so that opposite side edges 73,75 and 77,79 on stepped extensions 69,71 and opposite side edges 73a,75a and 77a,79a on stepped extensions 69a,71a are arranged at least closely adjacent and at least in part in facing relation with opposite sidewalls 57,59 and 61,63 of stepped slots 53,55 and opposed sidewalls 57a,59a and 61a,63a of stepped slots 53a,55a, respectively. Thus, with stepped extensions 69,71 and 69a,71a respectively disposed within stepped slots 53,55 and 53a,55a, it may be noted that centrifugal weight members 15,15a are at least in part contained or mechanically caged generally against movement with respect to arms 19,19a or displacement therefrom in a direction extending generally between opposite marginal edges 49,51 and 49a,51a across the arms, respectively. In addition when centrifugal weight members 15,15a are being assembled with arms 19,19a, it may also be noted that opposite fingers 81,83 and 81a,83a on the centrifugal weight members are respectively placed or otherwise assembled into engagement with slide surfaces 65,67 and 65a,67a on faces 47,47a of arms 19,19a, and in opposition to such engagement of the fingers and the slide surfaces, at least one of stepped extensions 69,71 and 69a,71a is engaged with its associated slot defining a confronting part on faces 45,45a of the arms, respectively. Thus, centrifugal weight members 15,15a are also contained or mechanically caged generally against movement with respect to arms 19,19a or displacement therefrom in a direction generally axially of hub 17, i.e., in a direction generally between opposite faces 45,47 and 45a,47a of the arms. In the light of the foregoing, caging means set 23,23a may be defined as including at least one of stepped extensions 69,71 and 69a,71a on centrifugal weight members 15,15a and also fingers 81,83 and 81a,83a, thereof, and guide set 21,21a may be defined as including at least one of stepped slots 53,55 and 53a,55a of arms 19,19a and also slide surfaces 65,67 and 65a,67a thereof.

Figure 1:
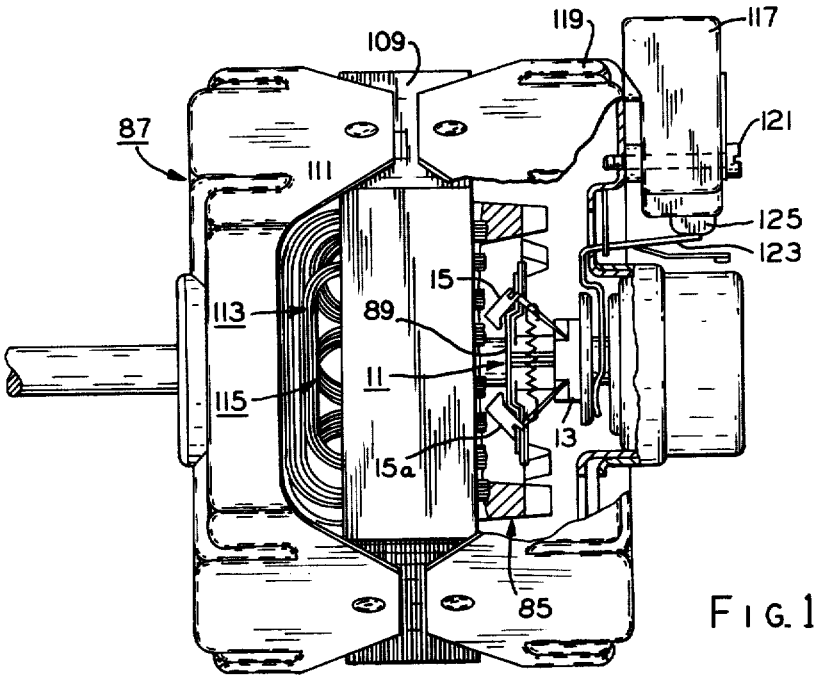
FIG. 1 is an elevational view of a prime mover with portions thereof broken away to show a switch actuating device in one form of the invention as mounted to a rotatable assembly of the prime mover so as to be generally conjointly rotatable therewith.
Figure 8:
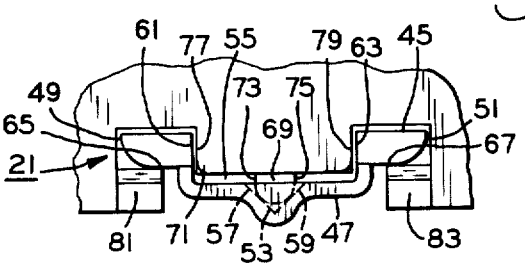
FIG. 8 is an enlarged partial view taken along line 8—8 of FIG. 5.

Referring again in general to the drawings and recapitulating at least in part with respect to the foregoing, switch actuating device 11 in one form of the invention is adapted for conjoint rotation with a rotatable assembly 85 of a prime mover 87 (FIG. 1). Means, indicated generally at 89, is adapted for mounting device 11 to rotatable assembly 85, and centrifugal weight members 15,15a are associated with the mounting means so as to be respectively slidable generally in a radial direction thereon when the device is conjointly rotated with the rotatable assembly (FIGS. 1 and 2). Caging means or caging means sets 23,23a are integral with centrifugal weight members 15,15a and slidable on confronting parts, such as for instance guide sets 21,21a, of mounting means 89 for mechanically caging the the centrifugal weight members generally against movement with respect to the mounting means or displacement therefrom in directions other than the radial direction at least during the conjoint rotation of device 11 with rotatable assembly 85 of prime mover 87 (FIG. 8).

More particularly and with specific reference to FIGS. 1-3, mounting means 89 comprises hub 17 and arms 19,19a, and a bore 91 is provided through the hub between a pair of opposite ends or end portions 93,95 thereof with the arms being integrally formed with the hub at least adjacent end portion 93 thereof. Hub bore 91 is adapted to be received in press-fitting engagement in a preselected assembly position on rotatable assembly 85, and of course, such press-fitting engagement is effective to cause the conjoint rotation of switch actuating device 11 with the rotatable assembly upon the energization of prime mover 87, as discussed hereinafter, however, it is contemplated that hub may be secured to the rotatable assembly by suitable means other than the aforementioned press-fitting engagement within the scope of the invention so as to meet the objects thereof. Thus, with mounting means 89 so fixedly secured to rotatable assembly 85, hub 17 is arranged so as to extend generally in the direction of the rotational axis of the rotatable assembly, and arms 19,19a are arranged so as to extend generally radially from the hub with respect to the rotational axis of the rotatable member. Of course, land sets 31,33 on peripheral surface 29 of hub 17 extend generally axially thereof between end portions 93,95 of the hub. Arms 19,19a respectively include a pair of abutments 97,97a on faces 45,45a thereof for supporting or engaging a pair of weight sections 99, 99a centrifugal weight members 15,15a in the at-rest positions thereof.

Push collar 13 includes a plurality of sets of angularly disposed stops or abutments 101 between which the pivot section plurality 103 are at least in part defined so as to pivotally support or receive the distal or pivoted ends of pivot legs 41,43 and 41a,43a on centrifugal weight members 15,15a. Of course, upon the axial movement of push collar 13 between its protracted and retracted positions on hub 7, pivot legs 41,43 and 41a,43a of centrifugal weight members 15,15a are pivotally movable about pivot sections 103 on push collar 13 at least toward abutment with respective ones of the stops in the set plurality 101 thereof. To complete the description of switch actuating device 11, pivot legs 41,43 and 41a,43a are respectively provided with a spring retainer or hooks 105,107 and 105a,107a to which springs 25,27 are interconnected thereby to bias or otherwise urge the pivot legs toward pivoting abutment with pivot sections 103 on push collar 13 and weight sections 99,99a of centrifugal weight members toward engagement with abutments 97,97a provided therefor on arms 19,19a.

Referring now to FIG. 1, prime mover or dynamoelectric machine 87 may be an electric motor of the single phase type in which rotatable assembly 85 is rotatably mounted or otherwise suitably journaled in a stationary assembly 109 of the prime mover. Stationary assembly 109 includes a winding circuit 111 having at least a pair of winding means, such as a main or run winding means and an auxiliary or start winding means indicated generally at 113, 115, respectively. A switch or switch assembly 117 is mounted to a structural component 119 of prime mover 87 by suitable switch mounting means, such as a metal bolt or screw or the like for instance, and albeit now shown, the switch assembly is connected in circuit controlling relation with winding circuit 111 so as to effect the deenergization of auxiliary winding means 115 upon the energization of the prime mover to its preselected or synchronous speed, as discussed in greater detail hereinafter. If a more detailed description of switch device 117 and its operation is desired, reference may be made to U.S. Pat. No. 4,095,073 issued June 13, 1978 to James P. Frank which is incorporated herein by reference. As previously mentioned, switch actuating device 11 is fixedly attached in a predetermined assembly position on rotatable assembly 85 by press-fitting bore 91 in hub 17 of the switch actuating device onto the rotatable assembly. When so press-fitted onto rotatable assembly 85, switch actuating device 11 is conjointly rotatable with the rotatable assembly, and push collar 13 axially movable between the aforementioned protracted or stand-still or start position and the aforementioned retracted or run position. A lever 123 is pivotally mounted to structural component 119 of prime mover 87 having one end driven by push collar 13 of switch actuating device 11 and the other end disposed in driving or operating engagement with the exterior end of a plunger or push button 125 of switch assembly 117. When prime mover 87 is deenergized, switch actuating device 11 is in its stand-still position pivoting lever 123 so as to exert a force on plunger 125 of switch assembly 117 actuating it so that main winding means 113 and auxiliary winding means 115 are connected with each other in winding circuit 111 of the prime mover. Of course, while the combination of switch actuating device 11 and lever 123 are disclosed as a means for effecting the operation or actuation of switch assembly 117, it is contemplated that the switch assembly may be actuated by means other than the lever or by the switch actuating device itself within the scope of the invention so as to be commensurate with the objects thereof.

Figure 5:
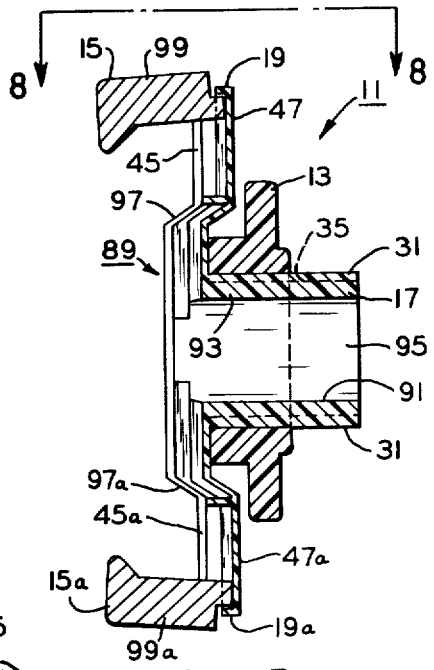
FIG. 5 is a sectional view taken along line 5—5 in FIG. 4 but showing the components of the switch actuating device in their actuated or displaced positions.

In the operation of prime mover 87 with switch actuating device 11 in its stand-still position as shown in FIGS. 1 and 2, winding circuit 111 of the prime mover is energized so as to effect the conjoint excitation of main winding means 113 and auxiliary winding means 115. Of course, since rotatable assembly 85 is magnetically coupled with stationary assembly 109 and winding circuit 111 of prime mover 87, the rotatable assembly is thereby rotatably driven in response to the energization of the prime mover, and switch actuating device 11 is conjointly rotated with the rotatable assembly. In response to this conjoint rotation of switch actuating device 11 with rotatable assembly 85, centrifugal weight members 15,15a of the switch actuating device are moved generally radially outwardly with the caging means sets 23,23a thereof in the aforementioned sliding engagement with guide sets 21,21a on arms 19,19a. In this manner, the sliding engagement of stepped extensions 69,69a on centrifugal weight members 15,15a within stepped slots 53,53a of arms 19,19a and the sliding engagement of fingers 81,83 and 81a,83a of the centrifugal weight members on slide surfaces 65,67 and 65a,67a of the arms is effective to mechanically cage the centrifugal weight members in an anti-chattering relation with the arms in a generally axial direction. Further, it may also be noted that the sliding engagements of at least one of opposite sides 57,59 and 57a,59a of stepped extensions 69,69a with opposed sidewalls 57,59 and 57a,59a of stepped slots 53,53a and opposite sides 77,79 and 77a,79a of stepped extensions 71,71a with opposed sidewalls 61,63 and 61a,63a of stepped slots 55,55a also serves to mechanically cage centrifugal weight members 15,15a in an anti-chattering relation with arms 15,15a generally in the direction between opposite side edges 49,51 and 49a,51a of arms 19,19a. Thus, with centrifugal members 15,15a so mechanically caged with arms 19,19a, the radially outward movement of the centrifugal members on the arms in response to the rotational movement of switch actuating device 11 is believed to be generally smooth and with a minimum of chatter or noise. Of course, the aforementioned radially outward movement of centrifugal weight members 15,15a on arms 19,19a is in opposition to the compressive forces of springs 25,27 and effects the pivotal movement of pivot legs 41,43 and 41a,43a of the centrifugal weight members about their respective pivot sections 103 on push collar 13. In response to this pivotal movement of pivot legs 41,43 and 41a,43a on pivot sections 103, push collar 13 is axially moved from its protracted or stand-still positions on hub 17 to the retracted or run position thereon, as shown in FIG. 5, and of course, groove sets 37,29 of the push collar are respectively slidable on land sets 31,33 of the hub so as to effect the axial movement of the push collar with respect to the hub.

Figure 9:
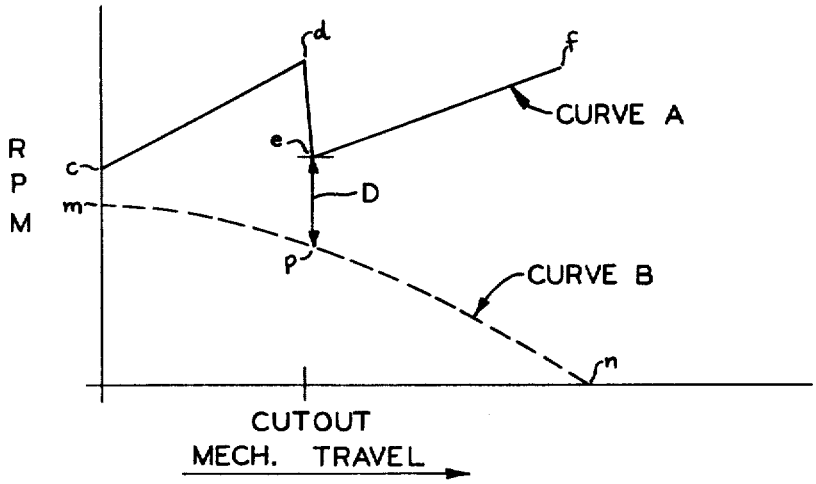
FIG. 9 is a graphical representation comparing the actual and equilibrium speeds of the rotatable assembly.

As described above, push collar 13 is axially moved to its retracted position on hub 17 of switch actuating device 11 generally as prime mover 87 is energized or comes up to its running speed, and such axial movement of the push collar allows lever 123 to pivot generally about structural component 119 of the prime mover so as to alleviate the force exerted on plunger 125 of switch assembly 117. When such force is removed from plunger 125, switch assembly 117 is operated thereby to effect the deexcitation of auxiliary winding means 115 in winding circuit 111 of prime mover 87, and thereafter, the prime mover continues to be energized generally at its running speed in response to the continued excitation of main winding means 113. The above discussed transition of prime mover 87 from its starting mode to its running mode is illustrated by the graphical representation in FIG. 9 in which curve A represents the energized speed of prime mover 87, i.e. the rotational speed of its rotatable assembly 87, and curve B represents the equilibrium speed of the rotatable assembly.

With reference to curve A and recapitulating at least in part with respect to the above discussed energization of prime mover 87, segment cd of curve A represents the increase in speed during the starting mode operation of the prime mover. Segment de of curve A represents a cut-out drop in the speed of the rotatable assembly generally about the time it attains its running speed. Of course, this cut-out drop occurs when push collar 13 of switch actuating device 11 is translated from the protracted position to the retracted position thereof causing the pivotal movement of linkage 123 to effect the operation of switch assembly 117 which cuts-out or deenergizes auxiliary winding means 115 of prime mover 87. Thereafter, as illustrated by segment ef of curve A, rotatable assembly 85 recovers or is again energized to the running speed thereof, as shown generally at point f, in response to the continued energization of main winding means 113. Curve B represents the equilibrium speed of rotatable assembly 85 which is that speed necessary to keep switch actuating device 11 moving in a positive direction, i.e. as push collar 13 moves from its protracted position to its retracted position. For instance, as rotatable assembly 85 is accelerated from the moment prime mover 87 is energized, the mass lag created by the inertia resistance of centrifugal weight members 15,15a allows for the large differential, indicated generally at D in FIG. 9, between the equilibrium speed and the actual speed of rotatable assembly 85 at cut-out, i.e. as represented by segment de of curve A, so that push collar 13 and the centrifugal weight members will keep moving in the aforementioned positive direction even though the speed of the rotatable assembly drops suddenly at cut-out. It is believed that the differential D starting at points e and p on curves A and B and increasing toward points f and n on curves A and B illustrates the improved mechanical stability of switch actuating device 11, i.e., its improved resistance to chatter or its anti-chattering characteristic, as previously discussed, and also its improved resistance to recycling in response to the above discussed cut-out speed drop as well as other speed interrupting impulses to which rotatable assembly 85 may be subjected.

From the foregoing, it is believed that a novel switch actuating device 11 and a novel method of assembling such has been provided meeting the objects and advantageous features set out hereinbefore, as well as others, and it is contemplated that changes in the precise arrangements, shapes, details and connections of the components of such switch actuating device, as well as the precise order of the method steps, may be made by those having ordinary skill in the art without departing from the spirit of the invention or the scope thereof, as set out in the claims which follow.

What I claim as new and desire to secure by Letters Patent of the United States is:

1. A switch actuating device adapted for conjoint rotation with a rotatable assembly generally about an axis of rotation thereof in a prime mover, the device comprising:

means integrally formed of a resin material adapted for mounting engagement on the rotatable assembly and having a hub arranged to extend generally axially in the direction of the rotational axis of the rotatable assembly and a pair of opposite arms arranged to extend generally radially from said hub with respect to the rotational axis of the rotatable member;

said hub including a pair of opposite end portions, an outer peripheral portion between said end portions, a bore extending generally axially through said hub between said opposite end portions and adapted to be press-fitted onto the rotatable assembly, a pair of sets of lands on said peripheral portions and extending generally axially between said opposite end portions with one of said land sets having a configuration different than that of the other of said land sets, and said opposite arms being integrally formed with said hub generally adjacent one of said opposite end portions;

said opposite arms respectively including a pair of opposite surfaces spaced apart from each other generally in the direction of the rotational axis of the rotatable assembly, a pair of opposite marginal edges interposed between said opposite surfaces, a pair of stepped slots in one of said opposite surfaces extending generally radially with respect to said hub with each of said stepped slots having a pair of generally opposed sidewalls, and a pair of abutments on one of said one opposite surface and the other of said opposite surfaces;

a generally annular push collar integrally formed of a resin material and arranged on said hub so as to be axially movable thereon between a retracted position at least adjacent said arm pair and a protracted position generally adjacent the other of said end portions of said hub, said push collar including another bore extending generally axially therethrough and arranged at least in part generally about said peripheral portion on said hub, a pair of sets of grooves in said push collar intersecting with said another bore and extending generally axially thereof so as to be received in axial guiding engagement with said land set pair on said hub and with said groove sets having configurations generally complimentary to those of said land sets, respectively, and a plurality of pairs of angularly disposed abutment surfaces on said push collar defining at least in part a plurality of pivot sections therebetween, respectively;

a pair of centrifugal weight members formed of a metallic material respectively pivotally associated with said push collar and slidably arranged with said arm pair of said mounting means, said centrifugal weight members respectively including a pair of opposite legs with each of said legs having a free end portion pivotally arranged with a respective one of said pivot sections of said plurality thereof on said push collar so as to be pivotally movable between respective ones of said angularly disposed abutment surface pairs of said plurality thereof on said push collar when said push collar is in its protracted and retracted positions, respectively, and a weight section interconnected between said opposite leg pair, said weight section having a pair of stepped extensions disposed in said stepped slot pair of said arm pair, each of said stepped extensions having a pair of opposite side edges received at least in part between said opposed sidewall pair of said stepped slot pair and at least one of said opposite side edge pair being slidable on one of said opposed sidewall pair, and a pair of opposed fingers on said weight sections generally adjacent the interconnection thereof with said leg pairs and slidably received on said other opposite surface of said arm pair generally adjacent said opposite marginal edges thereof, respectively; and a pair of means associated with adjacent opposite legs of said leg pair on said centrifugal weight members for resiliently urging said free end portions of said legs toward the pivotal arrangement thereof with said respective ones of said pivotal sections on said push collar and also said weight sections of said centrifugal weight member pair toward engagement with said abutment pair on said arm pair of said mounting engagement means.

2. A switch actuating device adapted for conjoint rotation with a rotatable assembly of a prime mover, the device comprising:

a hub including a pair of opposite end portions, an outer peripheral portion on said hub, a bore extending generally axially through said hub between said opposite end portions and adapted to be received on the rotatable assembly, a pair of sets of lands on said peripheral surface and extending generally axially between said opposite end portions with one of said land sets having a configuration different than that of the other of said land sets;

a pair of arms integrally formed with said hub generally adjacent one of said end portions thereof and extending generally radially in opposite directions from said hub, respectively;

a generally annular push collar including another bore extending generally axially therethrough and arranged at least in part generally about said peripheral portion on said hub, a pair of sets of grooves in said push collar intersecting with said another bore and extending generally axially thereof, said groove set pair having configurations generally complimentary to those of said land set pair so as to be received in axial sliding and guiding engagement therewith, respectively;

a pair of centrifugal weight members pivotally engaged with said push collar and slidably engaged with said arm pair, respectively; and a pair of means biased between said centrifugal weight members for resiliently urging them toward the respective engagements thereof with said push collar and said arm pair.

3. A switch actuating device as set forth in claim 2 wherein said arms respectively include at least one surface thereon, a pair of stepped slots in said at least one surface on said arms with each of said stepped slots having a pair of opposed sidewalls, and said centrifugal weight members including a pair of stepped extensions disposed in said stepped slots and with each of said stepped extensions having a pair of opposite side edges arranged at least in part between said opposed sidewall pairs of said stepped slots, respectively.

4. A switch actuating device as set forth in claim 2 wherein said arms respectively include a pair of opposite surfaces thereon, and a set of means on said centrifugal weight members arranged in sliding engagement with said opposite surfaces on each of said arms for preventing displacement of said weight members therefrom, respectively.

5. A switch actuating device as set forth in claim 4 wherein said displacement preventing means set includes a pair of oppositely extending fingers on each of said centrifugal weight means and slidable on one of said opposite surfaces on said each arm, and at least one extension on said each centrifugal weight member and slidable on the other of said opposite surfaces of said each arm.

6. A switch actuating device as set forth in claim 5 wherein said other opposite surfaces in said each arm respectively include slot means therein, said at least one extension on said each centrifugal weight members being slidable in said slot means, respectively.

7. A switch actuating device adapted for conjoint rotation with a rotatable assembly of a prime mover, the device comprising:

means adapted for mounting engagement with the rotatable assembly so as to be conjointly rotatable therewith;

a pair of arms integrally formed with said mounting means and extending generally in opposite radial directions therefrom, said arms respectively including a pair of opposite surfaces, and a pair of stepped slots in one of said opposite surfaces with each of said stepped slots having a pair of opposed sidewalls;

a push collar arranged on said mounting means so as to be axially movable thereon between a retracted position at least generally adjacent said arm pair and a protracted position axially displaced therefrom;

a pair of centrifugal weight members pivotally engaged with said push collar and respectively including a pair of stepped extensions disposed in said stepped slots of said arm pair, each of said stepped extensions having a pair of generally opposite side edges arranged at least in part between said opposed sidewall pairs of said stepped slots with at least one of said opposite side edge pairs on one of said stepped extensions being at least in part slidably engaged with one of said opposed sidewall pairs of one of said stepped slots; and a pair of resilient means biased between said centrifugal weight members for urging said push collar toward its protracted position and said at least one opposite side edge pair on said one extension toward the sliding engagement thereof with said one opposed sidewall pair of said one stepped slot of said arm pair, respectively.

8. A switch actuating device as set forth in claim 7 wherein said mounting means includes a pair of sets of axially extending lands with one of said land sets having a configuration different than that of the other of said land sets, and said push collar including a pair of sets of grooves received in axial guiding engagement on said land set pair on said mounting means, said groove set pair having configurations generally complimentary to those of said land set pair, respectively.

9. A switch actuating device as set forth in claim 8 wherein said mounting means further includes an outer peripheral surface, said land set pair extending from said peripheral surface, respectively.

10. A switch actuating device as set forth in claim 9 wherein said push collar includes a bore therethrough and disposed at least in part generally about said peripheral surface of said mounting means, said groove set pair intersecting with said bore, respectively.

11. A switch actuating device adapted for conjoint rotation with a rotatable assembly of a prime mover generally about the rotatable axis thereof, the device comprising:

means for conjoint rotation with the rotatable assembly generally about its rotatable axis and including means adapted for mounting to the rotatable assembly, a pair of opposite arms integral with said mounting means and extending generally radially with respect to the rotatable axis of the rotatable assembly, a pair of sets of oppositely facing guide surfaces on each of said arms, and a pair of abutments on said arms, respectively;

push collar means disposed on said mounting means so as to be conjointly rotatable therewith and arranged for movement axially thereof between a protracted position and a retracted position at least generally adjacent said arms;

means adapted for operation generally in response to the rotational speed of the rotatable assembly to effect the axial movement of said push collar means between its protracted position and its retracted position and including a pair of centrifugal weight members pivotally associated with said push collar means, and a pair of sets of opposed means on said centrifugal weight members arranged in sliding engagement with confronting ones of said oppositely facing guide surfaces of said pair of sets thereof on said arms for mechanically caging said centrifugal weight members with said arms generally against movement with respect thereto in a direction other than that of the sliding engagement of said mechanical caging means set pair with said confronting ones of said oppositely facing guide surfaces of said pair of sets thereof, respectively; and a pair of resilient means biased between said centrifugal weight members for urging said push collar means toward its protracted position and said centrifugal weight members toward said abutments, respectively.

12. A switch actuating device as set forth in claim 11 wherein said caging means set comprises a pair of fingers on said each centrifugal weight members and slidable on the respective confronting ones of said oppositely facing guide surfaces of one of said sets of said pair thereof, and at least one extension on said each centrifugal weight member slidable on other confronting ones of said oppositely facing guide surfaces of the other of said sets of said pair thereof, respectively.

13. A switch actuating device as set forth in claim 11 wherein said arms respectively include a pair of stepped slots in one set of said oppositely facing guide surfaces of said pair of sets thereof with each of said stepped slots having a pair of opposed sidewalls, and said caging means set including a pair of stepped extensions disposed in said stepped slot pair of said arms and with each of said stepped extensions having a pair of opposite side edges received at least in part between said opposed sidewall pair of stepped slot pair of said arms, respectively.

14. A switch actuating device as set forth in claim 13 wherein at least one of said opposite side edge pairs is at least in part slidable on one of said opposed sidewall pairs.

15. A switch actuating device as set forth in claim 11 wherein said mounting means includes a bore therethrough arranged to be press-fitted onto the rotatable assembly.

16. A switch actuating device as set forth in claim 11 wherein said mounting means includes an outer peripheral surface with at least a pair of sets of lands thereon extending generally in the direction of the rotatable axis of the rotatable assembly, one of said land sets of said at least pair thereof having a configuration different than that of another of said land sets of said at least pair thereof.

17. A switch actuating device as set forth in claim 16 wherein said switch operating means includes at least a pair of sets of grooves therein arranged in axial guiding engagement on said land sets of said at least pair thereof and with said groove sets having configurations generally complimentary to those of said land sets, respectively.

18. In a switch actuating device adapted for conjoint rotation with a rotatable assembly of a prime mover, the device having means adapted for mounting it to the rotatable assembly, and a pair of centrifugal weight members associated with the mounting means so as to be slidable generally in a radial direction thereon when the device is conjointly rotated with the rotatable assembly; the improvement comprising opposed means integral with the centrifugal weight members and respectively slidable on oppositely facing confronting parts of the mounting means for mechanically caging said centrifugal weight members generally against movement with respect to the mounting means in directions other than the radial direction at least during the conjoint rotation of the device with the rotatable assembly of the prime mover.

19. A method of assembling a switch actuating device including a push collar, a pair of centrifugal weight members, and means for mounting the switch actuating device with the mounting means having a generally axially extending hub and also having a pair of generally radially extending opposite arms with each of the arms having a pair of set of oppositely facing surfaces, respectively, the method comprising the steps of:

(a) disposing the push collar in axial sliding relation on the hub;

(b) associating the centrifugal weight members in pivotal engagement with the push collar and arranging a pair of sets of opposed means on the centrifugal weight members in sliding engagement with confronting ones of the oppositely facing surface set pair of the arms for mechanically caging the centrifugal weight members on the arms generally against movement with respect thereto other than in the direction of the sliding engagement of the centrifugal weight members on the arms, respectively; and (c) biasing a pair of resilient means between the centrifugal weight members for insuring the pivotal engagement between the centrifugal weight members and the push collar and the sliding engagement of the centrifugal weight members with the arms, respectively.

20. A switch actuating device adapted for conjoint rotation with a rotatable assembly of a prime mover, the device comprising:

means adapted for mounting engagement with the rotatable assembly so as to be conjointly rotatable therewith, said mounting means including a hub having a pair of generally axially spaced apart end portions, and outer peripheral surface, and a pair of arms on said hub generally adjacent one of said end portions thereof and extending generally radially in opposite directions from said hub;

a push collar generally axially movable on said hub and having an internal surface arranged at least in part generally about said outer peripheral portion of said hub;

a pair of sets of means respectively associated with each of said outer peripheral surface of said hub and said internal surface of said push collar and associated with each other for guiding the movement of said push collar on said hub, respectively, said guiding means set of one of said pair thereof having a configuration complementary to said guiding means set of the other of the pair thereof with a least one guiding means in said one set and said another set thereof having a configuration different than that of at least another guiding means in said one set and said another set thereof, respectively;

a pair of centrifugal weight members pivotally arranged with said push collar and slidably arranged with said arm pair, respectively; and means for resiliently urging said centrifugal weight members against displacement from the pivotal arrangement thereof with said push collar and from the slidable arrangement thereof with said arm pair, respectively.

* * * * *